United States Patent [19]

Cicin-Sain

[11] Patent Number: 4,682,428

[45] Date of Patent: Jul. 28, 1987

[54] RAILWAY BALLAST RENEWAL MACHINE FOR TUNNELS

[75] Inventor: Ivo Cicin-Sain, Bussigny-Laus., Switzerland

[73] Assignees: Danieli & C. Officine Meccaniche SpA; ITI/CLM Impianti Tecnici Industriali SpA, both of Buttrio, Italy

[21] Appl. No.: 865,127

[22] Filed: May 20, 1986

[30] Foreign Application Priority Data

May 24, 1985 [IT] Italy ..... 83371 A/85

[51] Int. Cl.[4] ..... E02F 5/22

[52] U.S. Cl. ..... 37/104; 104/7.1; 171/16

[58] Field of Search ..... 37/104–107; 171/16; 104/2, 5, 6, 7.1, 7.2, 7.3, 12

[56] References Cited

U.S. PATENT DOCUMENTS

| | | | |
|---|---|---|---|
| 3,144,833 | 8/1964 | Christoff et al. | 104/7.3 |
| 3,179,062 | 4/1965 | Christoff | 104/7.3 |
| 4,064,807 | 12/1977 | Theurer | 37/104 |
| 4,211,170 | 7/1980 | Theurer | 104/2 |
| 4,267,777 | 5/1981 | Theurer et al. | 104/7.1 |
| 4,400,897 | 8/1983 | Scheuchzer et al. | 37/104 |
| 4,417,522 | 11/1983 | Theurer et al. | 104/7.2 |
| 4,430,945 | 2/1984 | Theurer | 104/7.2 |
| 4,450,771 | 5/1984 | Theurer et al. | 37/104 |
| 4,479,439 | 10/1984 | Theurer et al. | 37/104 |
| 4,502,389 | 3/1985 | Theurer et al. | 104/2 |

FOREIGN PATENT DOCUMENTS

| | | |
|---|---|---|
| 3365/78 | 5/1978 | Austria . |
| 7461/79 | 11/1979 | Austria . |
| 59500 | 9/1982 | European Pat. Off. . |
| 2476708 | 8/1981 | France . |
| 67847A83 | 8/1983 | Italy . |
| 309855 | 12/1955 | Switzerland . |
| 634364 | 1/1983 | Switzerland . |

*Primary Examiner*—E. H. Eickholt

*Attorney, Agent, or Firm*—Wegner & Bretschneider

[57] ABSTRACT

A railway ballast renewal machine for renewing a railway road bed within a tunnel is disclosed. The device has a scarifier to loosing the metalling, a work unit to grip and retain the alignment of the rails as well as remove the metalling from between the sleepers, a riddle to sort the metalling, and a device to spread the sorted metalling back on the railway bed. The metalling is removed from between the sleepers by a movable case which moves vertically between the sleepers.

20 Claims, 9 Drawing Figures

RAILWAY BALLAST RENEWAL MACHINE FOR TUNNELS

Figure 1A:
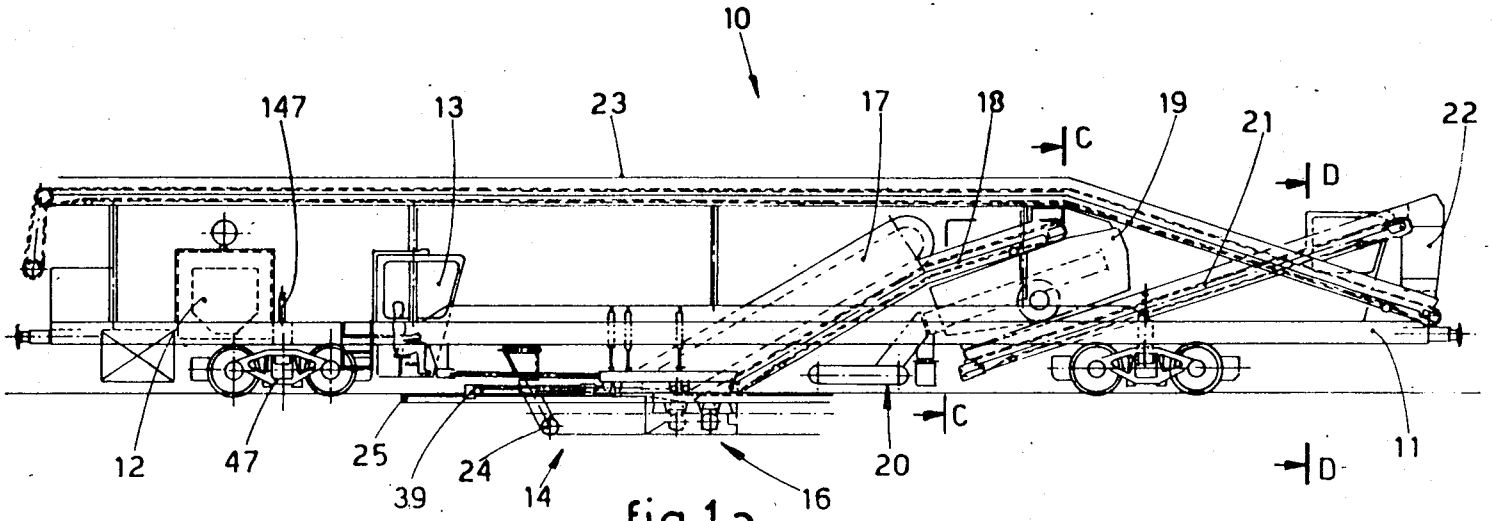

The field of application of this invention is the upkeep of railway lines. In particular, the specific field of application of the invention is the renewal of the railway road bed.

As is known, such renewal operations consist in removing the existing ballast by means of devices able to withdraw the metalling from below the rails and sleepers and in riddling such metalling. In fact, the metalling consists of components of various piece sizes and also of debris of a fine grain size (dust, mud and small fragments) and debris formed by bodies of large sizes (pieces of tree trunks, large stones and components of the attachments employed to secure the rails to the sleepers), and of other debris.

Such debris is separated out, generally with a vibrator riddle, and is sent to a discharge conveyor; the retained material, which consists of metalling of a piece size contained within given usability limits, is re-used and spread once more on the railway road bed beneath the rails.

As disclosed above, the invention finds particular application for use in the renewal of the ballast in railway tunnels and in all places in general where it is hard to have access to the railway laterally or where there is not enough room to permit renewal operations of the known type employed at present in the railway art.

Various renewal machines for upkeep of railway road beds are known in the art.

Application No. 67847 A/83 for a patent in Italy in the name of VALDITERRA discloses a regeneration machine for ballast in which a drag chain including a crosswise branch passing below the rails removes the metalling from under the railway line. The metalling is sent to a system of conveyors superimposed above one another which form as many riddling stages; the remaining metalling is delivered lastly to a vibrator riddle for the final sorting.

Pat. No. CH-A-309.855 discloses another machine of this type, which also comprises a vibrator riddle and conveyors to deliver material to such riddle and to discharge thereafter the material rejected and also includes means to spread the regenerated material. This machine too comprises a drag chain equipped with blades, a transverse branch of such chain passing below the rails to withdraw the metalling.

No. EP-A-0.059.500 discloses a machine which too is equipped with a drag chain system to collect the metalling and to send it thereafter to a vibrator riddle.

No. CH-A-634.364 discloses another machine in which a drag chain of the type cited above conveys the material thus scrapped directly to a vibrator riddle. Means to spread the regenerated metalling are comprised and consist of a conveyor; means consisting of another system of conveyors for discharge purposes are also included.

No. FR-A-2.476.708 also discloses a machine equipped with a drag chain passing under the railway line and with conveyors for the material scraped and with riddles to sort the various fractions. This invention deals in particular with a composite machine comprising a renewal carriage and a ballast tamping carriage coupled together.

Patent application No. AT 7461/79 in the name of PLASSER discloses a machine in which, besides the usual drag chain passing under the railway line, a further tracked scraper means is included downstream of such chain so as to perform a thorough scraping of the metalling. Both the chain and the tracked means have a considerable transverse bulk.

Patent application No. AT 3365/78 in turn discloses a regeneration machine equipped with a vibrator riddle and drag chain able to pass under the rails, which are suitably raised by engagement and lifting means. This invention dwells in particular on the riddle and conveyor means for the various fractions.

All the machines known in the art and described above comprise, as we have seen, a drag chain to scrape the metalling, such chain being equipped with blades and including a branch that extends crosswise below the railway line, the line being lifted or not lifted during the scraping operation. Such crosswise branch of the chain entails a considerable transverse bulk of the machine while working.

As a result, the known machines cannot work in tunnels or in any other conditions where there is not enough free space at the sides of the railway line.

Manual techniques are still employed to renew the ballast in tunnels or in like situations where access is very limited. However, it is impossible to work fast enough with gangs of workers and in fact manual renewal operations proceed very slowly.

This invention has the purpose of providing a machine able to perform renewal of railway ballast in tunnels and in all situations where lateral access to the railway line is difficult or impossible except with manual systems.

In fact, tunnels entail problems of lack of room at the sides of the railway line. The gap between the masonry at the base of tunnels and the sleepers generally amounts to some tens of centimetres or less. In some extreme cases at particular points on a railway line minimum gaps consisting of a few centimetres are reached, when indeed there is not actual direct contact between the tunnel and the sleepers. It is obvious that under such conditions the traditional machines definitely cannot work. In fact there is not even the minimum spare space at the sides of the railway line to enable a drag chain to be introduced and moved, for such chain, as we said before, always entails a considerable transverse bulk.

As an indication, it is possible to carry out ballast renewal with the machine of the present invention in tunnels at a speed of about 200 meters an hour or more, with a maximum of 280 meters an hour when working at full capacity. Results with this machine are therefore several times greater than with the manual techniques used in tunnels hitherto.

As we have said, besides enabling work to be done in tunnels or at otherwise inaccessible points on the line, the machine of this invention makes possible also normal operations on accessible railway lines.

The purposes of the invention are attained owing to the fact that the ballast renewal machine according to the invention is equipped with a work unit located below the machine itself. Such work unit carries out withdrawal of metalling from below the railway line with an intermittent action, by means of which the metalling is thrust out so as to protrude between one sleeper and the next.

The work unit of the invention operates step-by-step and its structure is such that it does not protrude from the maximum bulk of the whole machine in a direction crosswise to the rails. Moreover, the work unit of the invention has a width only slightly greater than that of the sleepers and can therefore work in the cited extreme conditions where there is a gap of only a few centimeters between the sleepers and the masonry of the tunnels or any bulky element present.

In a preferred embodiment such work unit comprises at its front a scarifier of a known type consisting of a drum equipped with blades which is able to rotate under the railway line. As is well known, such scarifier has the task of reducing the consistency of the metalling and making it easier to remove.

Behind this scarifier the invention provides a gripper device consisting of a frame equipped with grippers able to perform an action of engagement of the rails.

The grippers of the invention engage the rails by means of flanged rollers in such a way as to enable the rails to be kept raised and aligned during the continuous forward movement of the machine.

The frame which is a part of the gripper unit comprises guides in which there can run, with a step-by-step movement, a metalling removal unit, which is located below the railway line and has an overall width only slightly greater than that of the sleepers. The step of forward movement of this removal unit is equal to the distance between sleepers on the line.

This metalling removal unit consists of a scoop casing which advances step-by-step below the railway line. This scoop casing in turn is equipped with a liftable case provided with means to thrust and convey the metalling from the sides of the line to the middle in the free space between the sleepers. Such thrust means are lifted at each step of the scoop casing so as to lift the metalling, which is thus thrust between one sleeper and another and conveyed to the middle of the railway line. At each forward step the thrust means are retracted below the level of the sleepers, thus enabling the scoop casing to advance.

The step-by-step advance of the scoop casing is performed by applying force to the rails so as to draw the scoop casing forward, a gripper being provided which is connected to the end of a hydraulic cylinder system; when this gripper is clamped to the rails, it is possible to draw the metalling removal unit forward by one step.

When thus conveyed to the middle of the railway line by the metalling removal unit, the metalling is withdrawn by a bladed conveyor, preferably equipped with a forwarding chute, and is sent by another conveyor to a vibrator riddle of a known type.

The material having a piece size contained within the limits of re-use is retained and re-distributed. Materials which are too fine or too large (debris) are discharged by a system of conveyor belts.

This invention is therefore embodied with a railway ballast renewal machine for tunnels which is able to renew the railway road bed in tunnels and comprises a scarifier, a riddle and means to spread the material retained, being characterized in that it includes a work unit together with a scoop casing unit to remove metalling and a unit to grip the rails, the metalling being removed by being lifted through empty spaces in the railway line.

Figure 1B:
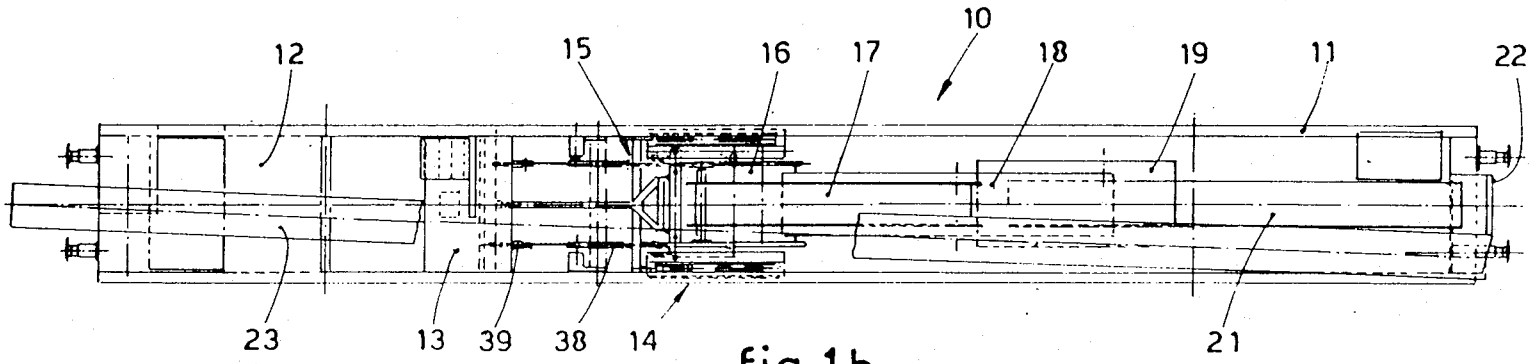
Figure 2A:
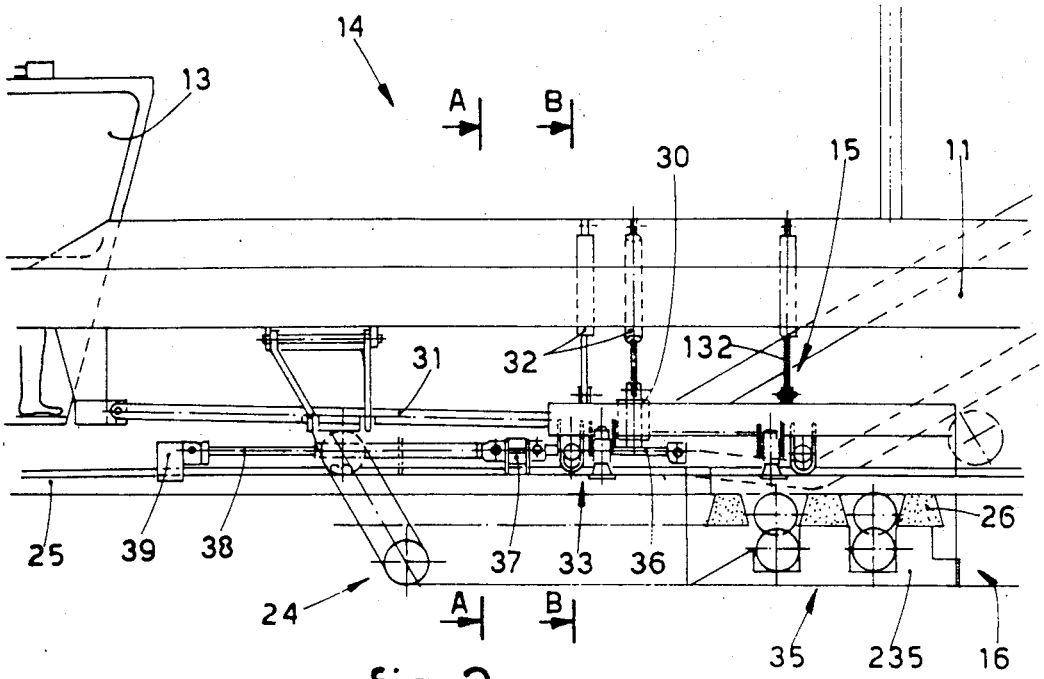
Figure 2B:
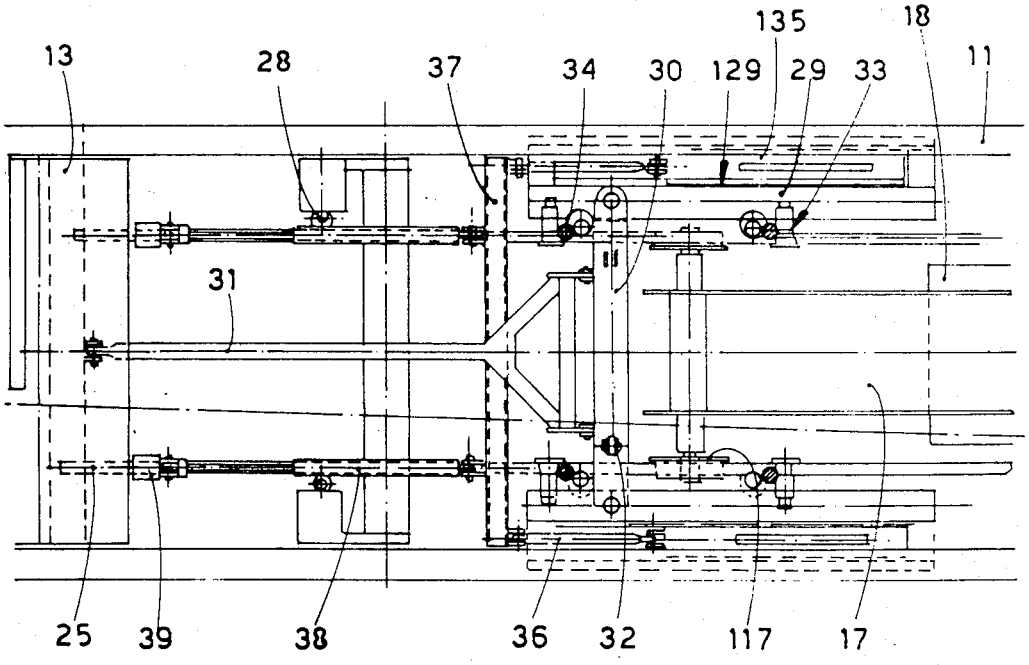
Figure 3A:
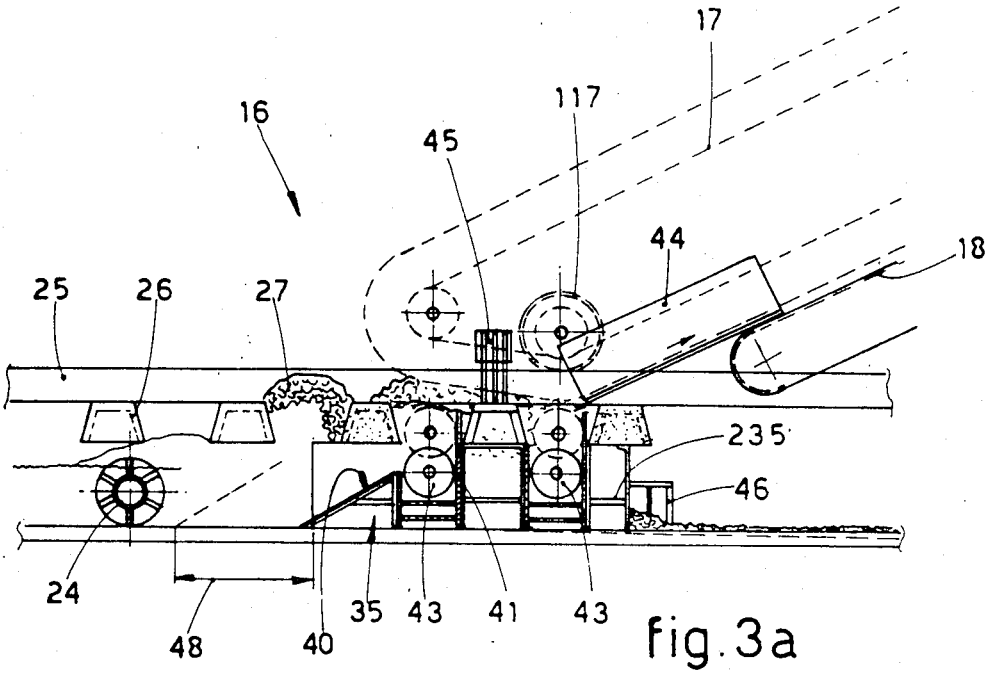
Figure 3B:
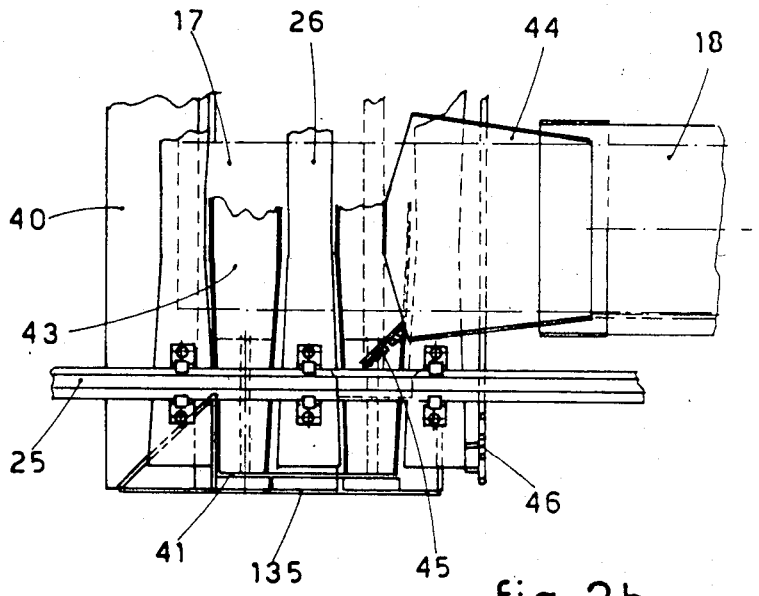

We shall now describe a preferred embodiment of the invention as a non-restrictive example with the help of the attached figures, in which:

FIGS. 1*a* and 1*b* are respectively side and plan overall views of a ballast renewal machine for tunnels according to the invention;

FIGS. 2*a* and 2*b* are respectively side elevation and plan views of the central portion of such renewal machine and show the work unit in particular;

FIG. 3*a* is a diagrammatic side view of the metalling removal unit;

FIG. 3*b* is a diagrammatic plan view of the unit of FIG. 3*a;*

Figure 4:
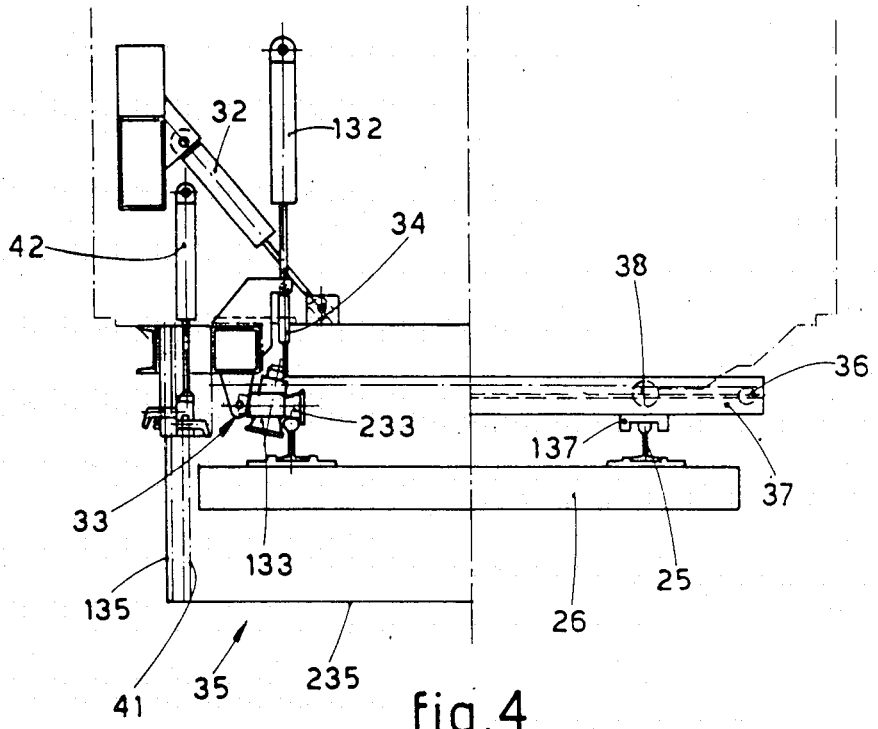
Figure 5:
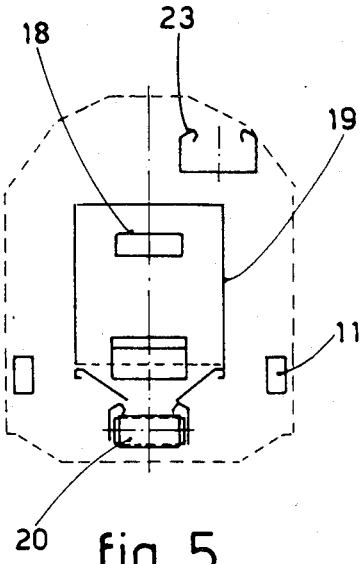
Figure 6:
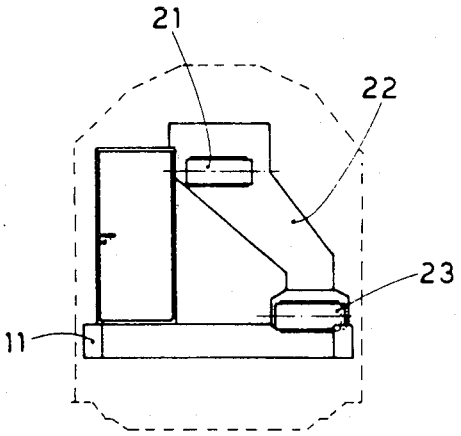

FIG. 4 is a view along two preferred sections A—A and B—B of FIG. 2*a* and shows the gripper unit;

FIGS. 5 and 6 give two sections, along C—C and D—D respectively of FIG. 1*a*, and show the lay-out of the vibrator riddle and of the various conveyor belts.

A ballast renewal machine for tunnels 10 of FIGS. 1*a* and 1*b* comprises a frame 11 on wheels, which bears in a known manner a motor unit 12 and a cab 13 with windows for the driver, who can supervise the working of the machine visually.

A work unit 14 is suspended below the frame 11 and comprises in its front portion a scarifier 24 of a type already known. Downstream of such scarifier 24 is a gripper unit 15 that cooperates with a metalling removal unit 16, which is positioned beneath the rails 25 while at work.

The metalling removal unit 16 transfers the metalling above the railway line by making it pass between one sleeper and another. Here the metalling is withdrawn by a first conveyor 17 that cooperates with a successive second conveyor 18, which conveys the metalling to a vibrator riddle 19.

Such vibrator riddle 19, which is of a known type, sorts the re-usable fractions of metalling, which are then sent to spreader conveyor means 20, from the debris which cannot be re-used. Such debris is removed by a third conveyor 21 and falls into a hopper 22, whence it is discharged by a fourth conveyor 23.

In the embodiment shown such fourth conveyor 23 passes over the machine 10 and discharges the debris at the front of the machine onto a collection waggon or other usage means, which is not shown here.

FIGS. 2*a* and 2*b* show in greater detail the work unit 14 positioned in the central portion of the machine.

A scarifier 24 of a known type is included at the front of the work unit 14 and consists of a cylinder equipped with blades and positioned crosswise below the rails 25. This scarifier 24 is suspended on the frame 11 and comprises alignment wheels 28; as we said earlier, it carries out a preliminary loosening of the metalling so as to facilitate removal of the same.

As we said before, the work unit 14 comprises a gripper unit 15 above the rails 25; this gripper unit 15 consists of two side frame members 29, each of which has a rectangular shape and is located next to its respective rail 25. Such side frame members 29 are connected together by a cross member 30, which in turn is connected to the main frame 11 of the machine 10 by a brace 31.

Such system enables the height of the work unit 15 to be adjusted. In particular, this adjustment of height is carried out by means of one set of hydraulic jacks 32 positioned obliquely and connecting the main frame 11 to the cross member 30, and of another set of jacks 132 positioned vertically and acting directly on brackets of the respective side frame member 29.

The actual grippers themselves consist of specially shaped rollers 33 that have a flanged shape so as to obtain a secure engagement of the rails.

As can be seen in particular in FIGS. 2*a* and 4, four rollers are comprised on each side; two of them on each side, bearing the reference 133, act sideways on the rail, whereas the other two 233 on each side act on the rail from above. In particular, these latter flanged rollers 233 can be secured to the rail through the action of hydraulic cylinders 34, which in this example are connected to the bracket on which the jacks 132 act. The stress of the clamping of the rails by the hydraulic cylinders 34 is discharged in this way by means of the jacks 132 onto the main frame 11 of the machine 10.

In their engagement position the flanged rollers 133–233 grip the rail 25 from the side and from above, and the rail is thus kept lifted and strictly aligned.

In particular, the system of jacks 32–132 provided to position the gripper unit 15, in cooperation with jacks 147 belonging to bogies 47, enables the ballast renewal machine 10 to be kept strictly horizontal whatever the sideways camber of the permanent way may be. The provision of rotatable rollers 133–233 to perform the gripping action enables such grip to be effected while the machine is moving continuously. The gripper unit 15, therefore, keeps the railway line raised and aligned at the same time as the machine continue to advance in its work.

Of course, when the machine is moving from one worksite to another, the whole gripper unit 15 is lifted by the jacks 32–132 within the clearance gauge laid down in the regulations.

Each of the side frame members 29 forming the gripper unit 15 comprises guides for lengthwise sliding 129 in which the lateral members 135 of a metalling-removal scoop casing 35 can slide. Such lateral members 135 are connected by tie rods 36 to a frontal cross member 37 of the machine. Hydraulic jacks 38 connect this cross member 37 to frontal grippers 39, so that each of the hydraulic jacks 38 bears one of such frontal grippers 39 at the end of its stem. The frontal grippers 39 engage their respective rails 25 whenever the scoop casing 35 has to be moved forwards by one step by the hydraulic jacks 38.

FIGS. 3*a* and 3*b* show in particular such metalling removal unit 16. The scoop casing 35 can move step-by-step and consists of two lateral members 135 cooperating with the guides 129 (see FIG. 2*b*) and of a base 235. The front portion of such base comprises a frontal ramp or scoop 40 which has the task of performing a first lifting of metalling 27 loosened by the scarifier 24. Final lifting of the metalling is carried out by a movable case 41 lodged on the base 235 and able to be lifted by jacks 42 shown in FIG. 4.

The movable case 41 in this example comprises means 43 to convey the metalling from the sides to the middle of the railway line. In the figure such means 43 consist of worm screws having substantially the form of a double cone, which fits the shape of the sleepers 26, as can be seen in FIG. 3*b*. Various shapes can be applied to the worm screws 43 to suit the straight or recessed or other shape of the sleepers 26 on which work is to be carried on momentarily.

Whenever the scoop casing 35 is moved forwards by one step, the movable case 41 is lifted. The metalling 27 is therefore thrust between the sleepers 26 and is withdrawn by the bladed first conveyor belt 17.

Such bladed first conveyor belt 17 comprises flanged alignment wheels 117 which cooperate with the rails 25 to maintain proper alignment with the railway line. It also includes a blade 44 able to support the metalling until the latter drops onto a second elevator conveyor 18 located below the first conveyor belt 17, as can be seen in FIG. 3*a*.

FIG. 3*b* shows forwarding brushes 45 positioned at the sides of the blade 44 and able to collect the metalling in the neighbourhood of the rails without damaging the components employed for attachment of the rails. This system enables the metalling to be withdrawn as efficiently as possible from above the rails 25.

Instead of the worm screws shown in FIGS. 3*a* and 3*b*, movable pistons or boxes can be employed, particularly with sleepers having a rectangular and not recessed shape, or else conveyor tracks or other means having the same functional purpose can be used.

In the example shown the worm screws borne by the movable case 41 are two in number. In this way the metalling brought to the surface by the first of the worm screws is prevented from falling into the empty space between the two immediately adjacent sleepers downstream.

An additional brush 46 solidly fixed to the base 235 of the scoop casing 35 is also included. The task of this brush 46 is to collect the last scattered fractions of metalling 27 remaining below the railway line after the pass of the metalling removal unit 16.

FIG. 4 shows diagrammatically the scoop casing 35 of the metalling removal unit 16. Moreover, it makes clear a plurality of jacks 42 which provide for the intermittent raising of the movable case 41 bearing the worm screw conveyors 43.

The righthand half-section of FIG. 4 shows in particular the front cross member 37 on which the jacks 38 act to cause the intermittent advance of the scoop casing 35.

Such front cross member 37 comprises guides 137 which cooperate with the rails 25 and which permit a slight sideways movement of adaptation. In fact, it is best to provide a not wholly rigid system in connection with the rails 25 so as to permit adaptation to the resistance encountered by the scoop casing 35 and to the conditions of the metalling.

FIGS. 5 and 6 show sections along C—C and D—D of FIG. 1*a* respectively. In FIG. 5 can be seen the vibrator riddle 19 with the second conveyor 18 and with a third distributor conveyor 20 positioned below; the figure also shows the fourth conveyor 23 which passes above the machine 10.

FIG. 6 shows a fifth conveyor 21 which takes debris from the vibrator riddle 19 to a hopper 22 and thence to a sixth conveyor 23 for discharge of such debris.

In a variant which is not shown here the scarifier 24 can be actuated step-by-step in solid connection with the scoop casing 35 or independently, instead of moving forward continuously together with the machine 10.

The ballast renewal machine 10 according to the invention functions as follows: the metalling removal unit 16 and the scarifier 24 are positioned first of all below the railway line. This may be performed, for instance, by cutting the rails 25 at any one point and inserting such units below the line. Otherwise, a sideways insertion system may perhaps be arranged by providing, for instance, a scarifier 24 and scoop casing 35 which can be suitably dismantled and re-assembled.

The machine 10 moves forward continuously to carry out renewal of the railway metalling. The gripper unit 15 keeps the line in its correct position and holds it lifted during the functioning of the work unit 16 located below the line. The gripper unit 15, as we said, advances continuously together with the machine 10.

The scarifier 24 loosens the metalling in front of the scoop casing 35, which is thus able to work in conditions of reduced resistance.

The scoop casing 35 advances by one step 48 at a time (see FIG. 3*a*) owing to the jacks 38, which draw it forward step-by-step, the frontal grippers 39 being clamped and unclamped at each step.

The front grippers 39 are thus clamped and pressure is applied to the jacks 38, the scoop casing 35 being advanced thereby by one step. The movable case 41 is now raised while the worm screws 43 rotate. This causes the metalling 27 to protrude between the sleepers 26, and the action of the worm screws 43 or equivalent conveyor means brings the metalling from the sides to the middle of the railway line. The metalling is then collected by the first conveyor 17 cooperating with the blade 44 and brushes 45. The metalling is thus conveyed to the second conveyor 18 and thence to the vibrator riddle 19.

When removal of the metalling protruding above the sleepers 26 has ended, the movable case 41 is lowered suddenly by the jacks 42 (see FIG. 4).

The frontal grippers 39 are released and the stems of the jacks 38 are extended; the frontal grippers 39 are clamped again and the scoop casing 35 is advanced by one step again by the action of the jacks 38.

We have described here a preferred embodiment of this invention, but variants are possible without departing thereby from the scope of the invention.

Thus, for instance, the shapes and proportions of the parts can be changed, as also can the conformation of the scoop casing 35; it is also possible to provide more than two transverse conveyors 43 of a type other than the worm screws shown; it is possible to arrange for any plurality of specially shaped gripper rollers 33, and first and second endless conveyors 17–18 other than those illustrated can be comprised. These and other variants are all possible for a person skilled in this field without departing thereby from the scope of the invention.

I claim:

1. A railway ballast renewal machine for renewing a railway road bed having rails attached to spaced sleepers embedded in metalling, comprising:

a frame;

a scarifier to loosen the metalling around the sleepers;

a work unit to grip the rails and remove the metalling;

a riddle to sort the metalling; and a means to spread retained metalling;

wherein said work unit comprises gripping means to grip the rails and removal means to lift out the metalling through spaces between successive sleepers of the railway roadbed.

2. A machine as claimed in claim 1, wherein the work unit is contained within the transverse bulk of the machine.

3. A machine as claimed in claim 1, further comprising means for advancing said removal means intermittently, said removal means having a working position located below the level of the rails.

4. A machine as claimed in claim 3, wherein the means for advancing comprises actuators connected to said removal means and attached to frontal grippers which engage the rails momentarily, thereby employing a force to advance said removal means intermittently on the rails.

5. A machine as claimed in claim 1, wherein said removal means comprises a vertically movable case to lift the metalling between the sleepers.

6. A machine as claimed in claim 5, wherein said vertically movable case comprises a conveying means to convey metalling from the ends of the sleepers to the middle of the sleepers.

7. A machine as claimed in claim 6, wherein said conveying means operates in at least two consecutive spaces between successive sleepers.

8. A machine as claimed in claim 6, wherein said conveying means comprises at least one worm screw for conveying the metalling.

9. A machine as claimed in claim 6, wherein said conveying means comprises at least one piston for conveying the metalling.

10. A machine as claimed in claim 6, wherein said conveying means comprises at least one movable box for conveying the metalling.

11. A machine as claimed in claim 1, wherein said removal means comprises a movable ramp for lifting the metalling from below the sleepers.

12. A machine as claimed in claim 5, wherein said removal means further comprises a movable ramp for lifting the metalling from below the sleepers.

13. A machine as claimed in claim 1, wherein said removal means comprises brushes to collect residual metalling.

14. A machine as claimed in claim 1, wherein said gripping means comprises gripper rollers to grip the rails.

15. A machine as claimed in claim 14, wherein said gripper rollers are arranged in pairs, one gripper of each pair of grippers being movable in order to clamp and unclamp the rail between the pair of grippers.

16. A machine as claimed in claim 1, wherein said gripping means comprises positioner jacks.

17. A machine as claimed in claim 1, wherein said gripping means comprises lateral frame members which guide the removal means.

18. A machine as claimed in claim 1, further comprising a bladed conveying means to lift the metalling removed by said removal means, and convey the metalling to a second conveying means.

19. A machine as claimed in claim 18, wherein said second conveying means delivers the metalling to the riddle.

20. A machine as claimed in claim 18, wherein said bladed conveying means comprises forwarding brushes located at the sides of a chute blade.

* * * * *